United States Patent [19]

Lee et al.

[11] Patent Number: 4,461,478

[45] Date of Patent: Jul. 24, 1984

[54] BOWLING BALL AND METHOD OF MANUFACTURE

[75] Inventors: Andrew J. Lee; Thomas E. Palmer; Dorris K. Mason, all of Hopkinsville, Ky.

[73] Assignee: Ebonite International, Inc., Hopkinsville, Ky.

[21] Appl. No.: 388,280

[22] Filed: Jun. 14, 1982

[51] Int. Cl.[3] ..... A63B 37/14

[52] U.S. Cl. ..... 273/63 R; 273/DIG. 8

[58] Field of Search ..... 273/63 R, 63 G, DIG. 8, 273/82 R, 63 D, 58 J

[56] References Cited

U.S. PATENT DOCUMENTS

| | | | |
|---|---|---|---|
| 3,206,201 | 9/1965 | Hendricks | 273/63 R |
| 3,229,978 | 1/1966 | Guglielmo | 273/DIG. 8 |
| 3,248,113 | 4/1966 | Baggenstoss et al. | 273/DIG. 8 |
| 3,350,252 | 10/1967 | Twickler | 273/63 R X |
| 3,807,733 | 4/1974 | Dearmont | 273/63 R |
| 4,131,277 | 12/1978 | Randolph | 273/63 E X |
| 4,133,527 | 1/1979 | Price | 273/63 D |
| 4,328,967 | 5/1982 | Orlando et al. | 273/63 D X |

*Primary Examiner*—George J. Marlo

*Attorney, Agent, or Firm*—Kinzer, Plyer, Dorn & McEachran

[57] ABSTRACT

The outer shell of a bowling ball, vulcanized in situ onto a spherical core, is formed of a mixture of sulfur-vulcanizable rubber, preferably SBR rubber, inert particulate filler such as rubber dust, sulfur, process oil, and polyurethane, with suitable accelerators and pigment. The polyurethane, comprising about two to about ten percent by weight of the shell, is preferably of a kind that is retarded in curing by the presence of the sulfur and is generally incompatible for polymerization with the rubber; the ball exhibits superior hooking and hitting characteristics and has high oil resistance.

29 Claims, 1 Drawing Figure

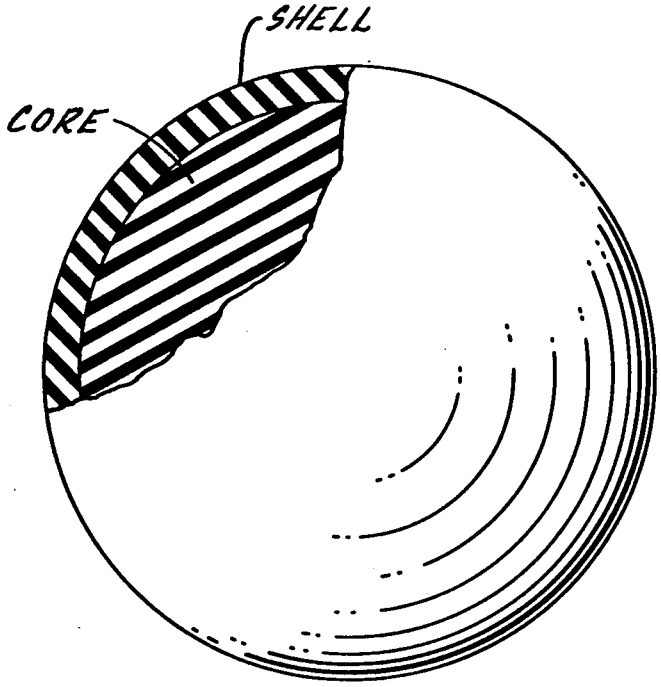
SHELL
CORE

BOWLING BALL AND METHOD OF MANUFACTURE

BACKGROUND OF THE INVENTION

Modern bowling balls utilize a two-part construction. The bowling ball usually comprises a large, spherical inner core formed of rubber, natural or synthetic, with a substantial quantity of inert filler; some cores may be formed with resins not ordinarily classified as rubber. The surface portion of the bowling ball, however, comprises a relatively thin veneer or shell over the entire core surface. In addition, it is customary to provide the bowling ball with a counterweight, called a "top weight", that is mounted in the core to compensate for the finger holes in the bowling ball.

For a bowling ball used in professional competition, in competition sanctioned by the American Bowling Congress, or in other high performance competition, two characteristics are of paramount importance. One of these is the striking power of the ball. A bowling ball having a surface that is relatively hard but quite resilient may cause the pins hit by the ball to fly upwardly in a manner such that they do not provide the pin-to-pin mixing action essential to high scoring. A ball with an optimum striking power has a surface that is soft enough to "give" somewhat in impacting the initial pins, so that pin movement is lower, with better mixing action and consequent improved scoring.

The second critical performance characteristic pertains to frictional engagement between the ball and the bowling lane. If the bowling ball has a very low coefficient of friction in its engagement with the usual maple or other hardwood lanes, the spin applied to the ball by the bowler will not have adequate effect, the hooking action required for optimum bowling performance will not be obtained, and scoring will deteriorate. Appreciable friction between the ball and the lane is essential to effective hooking action.

For a high performance bowling ball, other characteristics should also be present. One important additional characteristic pertains to oil resistance. The beginning of each bowling lane is customarily oiled to minimize contact damage in the area where the ball first engages the lane; oiling of the lanes may extend for as much as the first fifty feet. If the surface shell of a bowling ball absorbs oil from the lanes, appreciable variation and deterioration in ball performance occurs.

The forces to which the ball surface is subject, both when it strikes the lane and when it strikes the pins, are appreciable. The shell of a bowling ball must be capable of withstanding these impact forces literally thousands of times without deterioration if the ball is to have a reasonably useful life. The shell of the ball should not rub off on the surface of the lane, and conversely, should not be readily marked by contact with the lane or with the pins. For esthetic reasons, it should be possible to provide at least some color variation in the outer shell of the ball.

A bowling ball that has been generally superior, as regards all of the foregoing characteristics, utilizes an outer shell of polyurethane resin; see Baggenstoss et al U.S. Pat. No. 3,248,113 issued Apr. 26, 1966. A polyurethane shell, however, has one outstanding deficiency; it is much more expensive than a shell formed of natural rubber, SBR rubber, and others. Furthermore it may be necessary to process the shell material in liquid form, so that the conventional equipment available for molding other types of rubber onto the surface of a bowling ball core cannot be readily employed.

SUMMARY OF THE INVENTION

It is a principal object of the present invention, therefore, to provide a new and improved bowling ball construction and method of manufacture that results in a ball with high performance striking power and hooking characteristics, fully comparable to those of a ball having a polyurethane shell, but which is substantially less expensive to manufacture.

A corrollary object of the invention is to provide a new and improved bowling ball and method of manufacture that utilizes an outer shell formed predominantly of an inexpensive sulfur-vulcanizable rubber such as SBR rubber, or natural rubber, and that can be processed with conventional rubber molding equipment, which has superior striking power and hooking characteristics and high oil resistance.

Accordingly, in one aspect the invention relates to a bowling ball comprising a spherical core encapsulated in and bonded to an outer shell, molded in situ on the core, having a thickness of about 0.25 inch to about one inch, in which the outer shell is a homogeneous matrix of sulfur-vulcanized rubber, inert particulate filler, and partially cured polyurethane, the polyurethane constituting at least about two percent and no more than about ten percent by weight of the shell.

In another aspect, the invention relates to a bowling ball comprising a spherical core encapsulated in a vulcanized outer shell, molded in situ on the core, having a thickness of about 0.25 inch to about one inch, in which the outer shell is formed by a substantially homogenous matrix of the following principal ingredients, in descending order of content by weight:

sulfur-vulcanizable rubber;
inert particulate filler;
sulfur; and
polyurethane;

the polyurethane constituting about two percent to about ten percent, by weight, of the shell.

In a method aspect, the invention relates to a method of applying an outer shell to a bowling ball core comprising the following steps:

A. thoroughly comminuting and mixing together, to form a generally homogenous mixture, the following principal ingredients, in descending order of content by weight:

sulfur-vulcanizable rubber;
inert particulate filler;
sulfur; and
polyurethane;

B. applying the mixture of step A to the surface of a bowling ball core; and

C. curing the mixture, in situ on the core surface, to vulcanize the rubber and further disperse the polyurethene in the rubber.

In all aspects of the invention, the polyurethane resin is preferably of a type for which curing is retarded by the presence of sulfur and that is no more than partially compatible with the rubber.

BRIEF DESCRIPTION OF THE DRAWING

The single FIGURE in the drawing shows a bowling ball that is partially cut away to reveal internal construction.

DESCRIPTION OF THE PREFERRED EMBODIMENTS

As will be apparent from the foregoing discussion, the present invention relates to a method of forming the outer shell of a bowling ball, and to a bowling ball having an improved outer shell construction. The ball shell of the present invention is formed from a mixture of a sulfur-vulcanizable rubber, preferably SBR rubber, an inert particulate filler such as rubber dust, sulfur, process oil, and polyurethane, with suitable accelerators and one or more pigments. The foregoing listed ingredients are present in decreasing quantities by weight. In particular, the polyurethane comprises only about two percent to about ten percent by weight of the shell.

The polyurethane used in the bowling ball shell should preferably be of a kind that is retarded in curing by the presence of sulfur. Moreover, the selected polyurethane should preferably be generally incompatible with the rubber, as regards polymerization. That is, cross-linking between the polyurethane and the rubber, in the completed shell, should be minimal. The shell is vulcanized in place on the surface of a conventional bowling ball core, which typically may be a rubber core filled with rubber dust or other inert filler and including the usual top weight. The shell, after vulcanization, constitutes a homogenous blend of cured, filled rubber and only partially cured polyurethane. The ball has a high coefficient of friction and hence exhibits excellent hooking characteristics. At the same time, the striking power of the ball is excellent, appropriate for high level competition. Moreover, the oil resistance of the ball is quite high.

In a preferred embodiment of the invention, the initial step constitutes the mixing and milling, in a Banbury mill, of the following ingredients, in descending order of content by weight:

| Component | Parts | Percentage |
|---|---|---|
| Sulfur-vulcanizable rubber | 100 | 43.7% |
| Rubber dust filler: | | |
| hard | 37.04 | 16.2% |
| soft | 18.52 | 8.1% |
| total | 55.56 | 24.3% |
| Sulfur | 30.69 | 13.4% |
| Process Oil | 18.52 | 8.1% |
| Polyurethane gum | 11.11 | 4.9% |
| Magnesium Oxide Accelerator | 5.56 | 2.4% |
| Titanium Dioxide Pigment | 5.56 | 2.4% |
| Liquid Accelerator | 2.12 | 0.9% |

For this particular bowling ball shell mixture, the preferred rubber is a non-pigmented emulsion polymerized SBR rubber including 23.5% bound styrene, having a calculated specific gravity of 0.94, with viscosity ML-4 at 212° F. (100° C.) of 27, available commercially from Phillips Petroleum Company as PHILPRENE SBR 1506. The rubber dusts are conventional products, usually comprising finely comminuted tread material from used tires and other sources. A suitable process oil is SUNDECK 790, an aromatic oil commercially available from Sun Oil Company. The preferred polyurethane is a peroxide-cured millable gum, Vibrathane 5004, supplied by Uniroyal Chemical Division of Uniroyal, Inc., which is generally incompatible for polymerization with SBR rubber. This elastomer is prepared from polyester and isocyanate, having a density of about 1.15 and a Mooney viscosity ranging between 40 and 65 (ML-4 at 212° F.). The manufacturer advises that this elastomer "must be processed on equipment free of sulfur . . . sulfur poisons this system and retards efficient peroxide cure." A suitable liquid accelerator is Accelerator 808, a butyraldehyde-aniline condensation product available from E. I. duPont de Nemours & Co. The shell is applied to a conventional core of SBR rubber filled with rubber dust, with a preferred shell thickness of 0.25 to 0.375 inch.

In one effective manufacturing procedure, the foregoing mixture is first mixed and milled in the Banbury mill in a relatively large batch and then dropped onto an eighty-four inch rubber mill where the composition is sheeted off and sent through a batch-off cooling unit. Subsequently, a smaller quantity of the product of the initial mixing step is broken down in a smaller mill and again sheeted out and cooled. Discs of appropriate size are then punched out of the sheet, each disc including a sufficient quantity of the shell composition mixture to form one hemisphere of a bowling ball shell.

Two of these discs are then formed over a standard spherical bowling ball core, including the usual top weight, in a metal mold that completely encloses the rough ball. The mold containing the rough ball is then placed in a vulcanizer and the shell is cured. A suitable vulcanization cycle comprises heating the mold containing the rough ball to a temperature of 240° F. over a period of 45 minutes, following which the curing temperature is raised to 300° F. for a period of 5.5 hours and then reduced to a temperature of 270° F. during the succeeding 45 minutes.

This completes the curing of the shell of the bowling ball, vulcanizing the rubber in situ on the surface of the core. The only remaining procedure necessary is a standard surface finishing process.

The polyurethane utilized in the ball shell, though it constitutes a rather minor portion of the shell composition by weight, is perhaps the most critical ingredient. The particular polyurethane selected for use in the ball shell should be one which is retarded in curing by the presence of sulfur. Consequently, during vulcanization of the shell of the ball, the polyurethane does not cure or harden; on the contrary, it tends to soften. The end result after vulcanization is a homogenous blend of cured, filled SBR rubber and semi-cured polyurethane affording a shell surface with a high coefficient of friction. Moreover, the completed shell is highly oil resistant. On the other hand, the striking power of the completed bowling ball is excellent, equivalent to a high performance polyurethane shell ball.

A bowling ball shell compounded and processed as described above has a Rex D durometer hardness of approximately 78 to 80, easily meeting the requirement of the American Bowling Congress for a ball surfacing having a durometer of 72 or higher and the requirement of the professional Bowlers Association for a surface durometer of 75 or harder. The surface of the ball can be made harder by increasing the sulfur content of the shell composition or can be softened by reducing the sulfur content. The shell of the bowling ball should be relatively thin, since this is the most expensive component of the ball. A shell thickness of approximately $\frac{1}{4}$ inch to $\frac{3}{8}$ inch is quite satisfactory. On the other hand, if desired, the shell thickness can be increased, for example to about one inch.

Changing the polyurethane content of the bowling ball shell can affect its characteristics. The specific characteristic most affected by a change of this nature is the coefficient of friction, which determines the hooking attributes of the ball. Below about two percent, the polyurethane has little effect on the hooking characteristic; the ball does not have a high enough coefficient of friction for the desired hooking function. As the polyurethane content is increased from two percent to about five percent, the hooking characteristic increases substantially. Only a small increase in friction is afforded if the polyurethane content is increased further. Above about ten percent, any increase in the polyurethane content appears to have little or no further effect on the hooking characteristic of the ball. Oil resistance appears to follow essentially the same pattern. At approximately five percent by weight of polyurethane the ball shell has excellent characteristics with respect to both hooking and oil resistance.

It will be appreciated that the specific weight percentages for the different ingredients in the mixture that ultimately forms the ball shell are subject to variation. In general, to achieve the desired high performance characteristics for the bowling ball, at minimum expense, while retaining the capability of manufacture of the ball using conventional rubber-processing equipment, the weights of principal ingredients are preferably maintained within the following ranges, based on 100 parts of sulfur-vulcanizable rubber:

| | |
|---|---|
| particulate filler: | |
| hard rubber dust | 10 to 50 |
| soft rubber dust | 5 to 50 |
| total | 15 to 100 |
| process oil | 0 to 50 |
| polyurethane | 5 to 50 |
| pigment | 0 to 50 |

The sulfur is fixed to hardness; an increase in the sulfur content previously noted makes the ball shell harder, a decrease makes it softer. Increasing the accelerators (MgO and Accelerator 808) will shorten the curing (vulcanization) cycle, but leads to a possible sudden exotherm, causing the ball to decompose.

At present, SBR rubber is the least expensive material suitable for use as the largest component of the mixture forming the ball shell composition. However, other sulfur-vulcanizable rubbers, such as natural rubber, can be utilized. Moreover, it will be recognized that mixtures of two or more sulfur-vulcanizable rubbers can be utilized if desired, though there is little or nothing to be gained from this additional complication of the process and composition.

We claim:

1. A bowling ball comprising a spherical core encapsulated in and bonded to an outer shell, molded in situ on the core, having a thickness of about 0.25 inch to about one inch, in which the outer shell is a homogeneous matrix of sulfur-vulcanized rubber, inert particulate filler, and partially cured polyurethane, the polyurethane constituting at least about two percent and no more than about ten percent by weight of the shell.

2. A bowling ball according to claim 1 in which the polyurethane is of a type for which curing is retarded by sulfur.

3. A bowling ball according to claim 2 in which the polyurethane content of the shell matrix material is approximately five percent.

4. A bowling ball according to claim 1 or claim 2 or claim 3 in which the rubber is SBR rubber and the polyurethane is no more than partially compatible with the rubber.

5. A bowling ball comprising a spherical core encapsulated in a vulcanized outer shell, molded in situ on the core, having a thickness of about 0.25 inch to about one inch, in which the outer shell is formed by a substantially homogenous matrix of the following principal ingredients, in descending order of content by weight:

sulfur-vulcanizable rubber;
inert particulate filler;
sulfur; and
polyurethane;

the polyurethane constituting about two percent to about ten percent, by weight, of the shell.

6. A bowling ball according to claim 5 in which the polyurethane content of the shell matrix is approximately five percent.

7. A bowling ball according to claim 5 or claim 6 in which the polyurethane is no more than partially compatible with the rubber and is of a type that is retarded in curing by sulfur.

8. A bowling ball according to claim 7 in which the rubber is SBR rubber.

9. A bowling ball according to claim 5 in which the components of the shell matrix are present in the following ranges in parts by weight, for 100 parts of sulfur-vulcanizable rubber:

filler: 15 to 100
polyurethane: 5 to 50
process oil: 0 to 50 with about 30 parts sulfur, adjusted to provide desired hardness for the ball shell.

10. A bowling ball according to claim 9 in which the polyurethane is of a type for which curing is retarded by sulfur.

11. A bowling ball according to claim 10 in which the rubber is SBR rubber.

12. A bowling ball according to claim 9 or claim 10, or claim 11, in which the filler comprises hard rubber dust, 10 parts to 50.

13. A bowling ball according to claim 12 in which the filler further comprises soft rubber dust, 5 parts to 50.

14. A bowling ball according to claim 9, or claim 10, or claim 11, in which the shell matrix further includes a pigment, up to 50 parts by weight.

15. A bowling ball according to claim 5 in which the components of the shell matrix are in approximately the following percentages by weight:

rubber: 43.7%
filler: 24.3%
sulfur: 13.4%
process oil: 8.1%
polyurethane: 4.9%
magnesium oxide: 2.4%
pigment: 2.4%
liquid accelerator: 0.9%;

and in which the polyurethane is of a type for which curing is retarded by sulfur and which is no more than partially compatible with the rubber.

16. A bowling ball according to claim 15 in which the rubber is SBR rubber.

17. A bowling ball according to claim 15, or claim 16 in which the pigment is titanium dioxide.

18. A bowling ball according to claim 15 or claim 16 utilizing a liquid accelerator that is a condensation product of butryaldehyde-aniline.

19. A bowling ball according to claim 15, or claim 16 in which the particulate filler is rubber dust.

20. A bowling ball according to claim 19 in which the rubber dust comprises hard rubber dust and soft rubber dust in a ratio of about 2:1.

21. The method of applying an outer shell to a bowling ball core comprising the following steps:

A. thoroughly comminuting and mixing together, to form a generally homogenous mixture, the following principal ingredients, in descending order of content by weight:

sulfur-vulcanizable rubber;

inert particulate filler;

sulfur; and polyurethane;

B. applying the mixture of step A to the surface of a bowling ball core; and

C. curing the mixture, in situ on the core surface, to vulcanize the rubber and further disperse the polyurethane in the rubber.

22. The method of claim 21 in which the polyurethane is of a type which is retarded in curing by sulfur so that the sulfur inhibits curing of the polyurethane in step C.

23. The method of claim 22 in which, in step A, the polyurethane is between about two percent and about ten percent by weight.

24. The method of claim 22 in which, in step A, the polyurethane is about five percent by weight.

25. The method of claim 21, or claim 22, or claim 23, or claim 24, in which SBR rubber is used as the sulfur-vulcanizable rubber.

26. The method of claim 25 in which rubber dust is used as the filler.

27. The method of claim 21 in which the ingredients used in Step A, in approximate parts by weight, based on 100 parts of sulfur-vulcanizable rubber, are:

inert filler: 15 to 100 polyurethane: 5 to 50 with additional ingredients comprising:

process oil: 0 to 50 pigment: 0 to 50 and about 30 parts sulfur, adjusted to provide desired hardness for the ball shell.

28. The method of claim 21 in which the ingredients in step A, in approximate percentages by weight, are:

rubber: 43.7% rubber dust filler: 24.3% sulfur: 13.4% process oil: 8.1% polyurethane: 4.9% magnesium oxide accelerator: 2.4%

$TiO_2$ pigment: 2.4%

Accelerator 808: 0.9%;

and in which the polyurethane is of a type retarded in curing by sulfur so that the sulfur inhibits curing of the polyurethane in step C.

29. The method of claim 27 or claim 28 in which step C includes maintaining the shell mixture at a temperature of about 300° F. for a period of about 5½ hours.

* * * * *